US008596381B2

(12) United States Patent
Hall et al.

(10) Patent No.: US 8,596,381 B2
(45) Date of Patent: Dec. 3, 2013

(54) SENSOR ON A FORMATION ENGAGING MEMBER OF A DRILL BIT

(76) Inventors: David R. Hall, Provo, UT (US); Francis Leany, Salem, UT (US); Scott Woolston, Provo, UT (US); Daniel Manwill, Provo, UT (US)

( * ) Notice: Subject to any disclaimer, the term of this patent is extended or adjusted under 35 U.S.C. 154(b) by 295 days.

(21) Appl. No.: 13/077,970

(22) Filed: Mar. 31, 2011

(65) Prior Publication Data

US 2011/0180325 A1 Jul. 28, 2011

Related U.S. Application Data

(63) Continuation of application No. 13/077,964, filed on Mar. 31, 2011, now Pat. No. 8,191,651, which is a continuation-in-part of application No. 12/619,305, filed on Nov. 16, 2009, which is a continuation-in-part of application No. 11/766,975, filed on Jun. 22, 2007, now Pat. No. 8,122,980, application No. 13/077,970, which is a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 13/077,970, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770, which is a continuation-in-part of application No. 11/673,634, filed on Feb. 12, 2007, now Pat. No. 8,109,349.

(51) Int. Cl.
*E21B 10/26* (2006.01)

(52) U.S. Cl.
USPC ..... 175/40; 175/432

(58) Field of Classification Search
USPC ..... 175/56, 432, 381
See application file for complete search history.

(56) References Cited

U.S. PATENT DOCUMENTS 616,118 A 12/1889 Kunhe
465,103 A 12/1891 Wegner (Continued)

*Primary Examiner* — John Kreck
(74) *Attorney, Agent, or Firm* — Philip W. Townsend, III

(57) ABSTRACT

In one aspect of the present invention, a drilling assembly comprises a drill bit comprising a bit body and a cutting surface. A formation engaging element protrudes from the cutting surface and is configured to engage a formation. At least one compliant member is disposed intermediate the bit body and formation engaging element and is configured to provide compliancy in a lateral direction for the formation engaging element.

19 Claims, 17 Drawing Sheets

(56) References Cited

U.S. PATENT DOCUMENTS

| | | | | | |
|---|---|---|---|---|---|
| 946,060 | A | | 1/1910 | Looker | |
| 1,116,154 | A | | 11/1914 | Stowers | |
| 1,183,630 | A | | 5/1916 | Bryson | |
| 1,189,560 | A | | 7/1916 | Gondos | |
| 1,360,908 | A | | 11/1920 | Everson | |
| 1,387,733 | A | | 8/1921 | Midgett | |
| 1,460,671 | A | | 7/1923 | Hebsacker | |
| 1,544,757 | A | | 7/1925 | Hufford | |
| 2,169,223 | A | | 8/1931 | Christian | |
| 1,821,474 | A | | 9/1931 | Mercer | |
| 1,879,177 | A | | 9/1932 | Gault | |
| 2,054,255 | A | | 9/1936 | Howard | |
| 2,064,255 | A | | 12/1936 | Garfield | |
| 2,218,130 | A | | 10/1940 | Court | |
| 2,320,136 | A | | 5/1943 | Kammerer | |
| 2,345,024 | A | | 3/1944 | Bannister | |
| 2,466,991 | A | | 4/1949 | Kammerer | |
| 2,467,376 | A | * | 4/1949 | Francis, Jr. | 175/56 |
| 2,540,464 | A | | 2/1951 | Stokes | |
| 2,544,036 | A | | 3/1951 | Kammerer | |
| 2,613,918 | A | * | 10/1952 | Long | 175/248 |
| 2,725,215 | A | | 9/1955 | Macneir | |
| 2,755,071 | A | | 7/1956 | Kammerer | |
| 2,776,819 | A | | 1/1957 | Brown | |
| 2,819,043 | A | | 1/1958 | Henderson | |
| 2,838,284 | A | | 6/1958 | Austin | |
| 2,894,722 | A | | 7/1959 | Buttolph | |
| 2,901,223 | A | | 8/1959 | Scott | |
| 2,950,087 | A | * | 8/1960 | Gregory | 175/103 |
| 2,963,102 | A | | 12/1960 | Smith | |
| 3,135,341 | A | | 6/1964 | Ritter | |
| 3,294,186 | A | | 12/1966 | Buell | |
| 3,301,339 | A | | 1/1967 | Pennebaker | |
| 3,379,264 | A | | 4/1968 | Cox | |
| 3,429,390 | A | | 2/1969 | Bennett | |
| 3,493,165 | A | | 2/1970 | Schonfield | |
| 3,583,504 | A | | 6/1971 | Aalund | |
| 3,764,493 | A | | 10/1973 | Rosar | |
| 3,821,993 | A | | 7/1974 | Kniff | |
| 3,955,635 | A | | 5/1976 | Skidmore | |
| 3,960,223 | A | | 6/1976 | Kleine | |
| 4,081,042 | A | | 3/1978 | Johnson | |
| 4,096,917 | A | | 6/1978 | Harris | |
| 4,106,577 | A | | 8/1978 | Summers | |
| 4,109,737 | A | | 8/1978 | Bovenkerk | |
| 4,176,723 | A | | 12/1979 | Arceneaux | |
| 4,253,533 | A | | 3/1981 | Baker | |
| 4,261,425 | A | * | 4/1981 | Bodine | 175/106 |
| 4,280,573 | A | | 7/1981 | Sudnishnikov | |
| 4,304,312 | A | | 12/1981 | Larsson | |
| 4,307,786 | A | | 12/1981 | Evans | |
| 4,397,361 | A | | 8/1983 | Langford | |
| 4,416,339 | A | | 11/1983 | Baker | |
| 4,445,580 | A | | 5/1984 | Sahley | |
| 4,448,269 | A | | 5/1984 | Ishikawa | |
| 4,499,795 | A | | 2/1985 | Radtke | |
| 4,531,592 | A | | 7/1985 | Hayatdavoudi | |
| 4,535,853 | A | | 8/1985 | Ippolito | |
| 4,538,691 | A | | 9/1985 | Dennis | |
| 4,566,545 | A | | 1/1986 | Story | |
| 4,574,895 | A | | 3/1986 | Dolezal | |
| 4,640,374 | A | | 2/1987 | Dennis | |
| 4,852,672 | A | | 8/1989 | Behrens | |
| 4,889,017 | A | | 12/1989 | Fuller | |
| 4,962,822 | A | | 10/1990 | Pascale | |
| 4,981,184 | A | | 1/1991 | Knowlton | |
| 5,009,273 | A | | 4/1991 | Grabinski | |
| 5,018,590 | A | * | 5/1991 | Weldon | 175/105 |
| 5,027,914 | A | | 7/1991 | Wilson | |
| 5,038,873 | A | | 8/1991 | Jurgens | |
| 5,119,892 | A | | 6/1992 | Clegg | |
| 5,141,063 | A | | 8/1992 | Quesenbury | |
| 5,186,268 | A | | 2/1993 | Clegg | |
| 5,222,566 | A | | 6/1993 | Taylor | |
| 5,255,749 | A | | 10/1993 | Bumpurs | |
| 5,265,682 | A | | 11/1993 | Russell | |
| 5,361,859 | A | * | 11/1994 | Tibbitts | 175/286 |
| 5,410,303 | A | | 4/1995 | Comeau | |
| 5,417,292 | A | | 5/1995 | Polakoff | |
| 5,423,389 | A | | 6/1995 | Warren | |
| 5,507,357 | A | | 4/1996 | Hult | |
| 5,553,678 | A | * | 9/1996 | Barr et al. | 175/73 |
| 5,560,440 | A | | 10/1996 | Tibbitts | |
| 5,568,838 | A | | 10/1996 | Struthers | |
| 5,655,614 | A | | 8/1997 | Azar | |
| 5,678,644 | A | | 10/1997 | Fielder | |
| 5,732,784 | A | | 3/1998 | Nelson | |
| 5,794,728 | A | | 8/1998 | Palmberg | |
| 5,848,657 | A | | 12/1998 | Flood | |
| 5,896,938 | A | | 4/1999 | Moeny | |
| 5,947,215 | A | | 9/1999 | Lundell | |
| 5,950,743 | A | | 9/1999 | Cox | |
| 5,957,223 | A | | 9/1999 | Doster | |
| 5,957,225 | A | | 9/1999 | Sinor | |
| 5,967,247 | A | | 10/1999 | Pessier | |
| 5,979,571 | A | | 11/1999 | Scott | |
| 5,992,547 | A | | 11/1999 | Caraway | |
| 5,992,548 | A | | 11/1999 | Silva | |
| 6,021,859 | A | | 2/2000 | Tibbitts | |
| 6,039,131 | A | | 3/2000 | Beaton | |
| 6,131,675 | A | | 10/2000 | Anderson | |
| 6,150,822 | A | | 11/2000 | Hong | |
| 6,186,251 | B1 | | 2/2001 | Butcher | |
| 6,202,761 | B1 | | 3/2001 | Forney | |
| 6,213,226 | B1 | | 4/2001 | Eppink | |
| 6,223,824 | B1 | | 5/2001 | Moyes | |
| 6,269,893 | B1 | | 8/2001 | Beaton | |
| 6,296,069 | B1 | | 10/2001 | Lamine | |
| 6,332,503 | B1 | | 12/2001 | Pessier | |
| 6,340,064 | B2 | | 1/2002 | Fielder | |
| 6,364,034 | B1 | | 4/2002 | Schoeffler | |
| 6,394,200 | B1 | | 5/2002 | Watson | |
| 6,408,959 | B2 | | 6/2002 | Bertagnolli | |
| 6,439,326 | B1 | | 8/2002 | Huang | |
| 6,474,425 | B1 | | 11/2002 | Truax | |
| 6,484,825 | B2 | | 11/2002 | Watson | |
| 6,484,826 | B1 | | 11/2002 | Anderson | |
| 6,510,906 | B1 | | 1/2003 | Richert | |
| 6,513,606 | B1 | | 2/2003 | Krueger | |
| 6,533,050 | B2 | | 3/2003 | Molloy | |
| 6,594,881 | B2 | | 7/2003 | Tibbitts | |
| 6,601,454 | B1 | | 8/2003 | Botnan | |
| 6,622,803 | B2 | | 9/2003 | Harvey | |
| 6,668,949 | B1 | | 12/2003 | Rives | |
| 6,672,406 | B2 | | 1/2004 | Beuershausen | |
| 6,729,420 | B2 | | 5/2004 | Mensa-Wilmot | |
| 6,732,817 | B2 | | 5/2004 | Dewey | |
| 6,822,579 | B2 | | 11/2004 | Goswami | |
| 9,629,076 | | | 4/2005 | Fanuel | |
| 6,953,096 | B2 | | 10/2005 | Gledhill | |
| 8,191,651 | B2 | * | 6/2012 | Hall et al. | 175/40 |
| 2001/1000494 | | | 6/2001 | Jensen | |
| 2003/0212621 | A1 | | 11/2003 | Poulter | |
| 2004/0238221 | A1 | | 12/2004 | Runia | |
| 2004/0256155 | A1 | | 12/2004 | Kriesels | |

* cited by examiner

SENSOR ON A FORMATION ENGAGING MEMBER OF A DRILL BIT

CROSS REFERENCE TO RELATED APPLICATION

This application is a continuation of U.S. patent application Ser. No. 13/077,964, filed Mar. 31, 2011, now U.S Pat. No. 8,191,561 which is a continuation-in-part of U.S. patent application Ser. No. 12/619,305, filed Nov. 16, 2009, which is a continuation-in-part of U.S. patent application Ser. No. 11/766,975 and was filed on Jun. 22, 2007 now U.S Pat. No. 8,122,980. This application is also a continuation-in-part of U.S. patent application Ser. No. 11/774,227 which was filed on Jul. 6, 2007 now U.S Pat. No. 7,669,938. U.S. patent application Ser. No. 11/774,227 is a continuation-in-part of U.S. patent application Ser. No. 11/773,271 which was filed on Jul. 3, 2007 now U.S Pat. No. 7,997,661. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007 now abandoned. U.S. patent application Ser. No. 11/766,865 is a continuation-in-part of U.S. patent application Ser. No. 11/742,304 which was filed on Apr. 30, 2007 now U.S Pat. No. 7,475,948. U.S. patent application Ser. No. 11/742,304 is a continuation of U.S. patent application Ser. No. 11/742,261 which was filed on Apr. 30, 2007 now U.S Pat. No. 7,469,971. U.S. patent application Ser. No. 11/742,261 is a continuation-in-part of U.S. patent application Ser. No. 11/464,008 which was filed on Aug. 11, 2006 now U.S Pat. No. 7,338,135. U.S. patent application Ser. No. 11/464,008 is a continuation-in-part of U.S. patent application Ser. No. 11/463,998 which was filed on Aug. 11, 2006 now U.S Pat. No. 7,348,105. U.S. patent application Ser. No. 11/463,998 is a continuation-in-part of U.S. patent application Ser. No. 11/463,990 which was filed on Aug. 11, 2006 now U.S Pat. No. 7,320,505. U.S. patent application Ser. No. 11/463,990 is a continuation-in-part of U.S. patent application Ser. No. 11/463,975 which was filed on Aug. 11, 2006 now U.S Pat. No. 7,445,294. U.S. patent application Ser. No. 11/463,975 is a continuation-in-part of U.S. patent application Ser. No. 11/463,962 which was filed on Aug. 11, 2006 now U.S Pat. No. 7,413,256. U.S. patent application Ser. No. 11/463,962 is a continuation-in-part of U.S. patent application Ser. No. 11/463,953, which was also filed on Aug. 11, 2006 now U.S Pat. No. 7,464,993. The present application is also a continuation-in-part of U.S. patent application Ser. No. 11/695672 which was filed on Apr. 3, 2007 now U.S Pat. No. 7,396,086. U.S. patent application Ser. No. 11/695672 is a continuation-in-part of U.S. patent application Ser. No. 11/686,831 filed on Mar. 15, 2007 now U.S Pat. No. 7,568,770. This application is also a continuation in part of U.S. patent application Ser. No. 11/673,634, filed Feb. 12 2007, now U.S Pat. No. 8,109,349. All of these applications are herein incorporated by reference for all that they contain.

BACKGROUND OF THE INVENTION

The present invention relates to drill bit assemblies, specifically drill bit assemblies for use in subterranean drilling. More particularly the present invention relates to drill bits that include engaging members that degrade the formation through shear and/or compressive forces.

U.S. Pat. No. 7,270,196 to Hall, which is herein incorporated by reference for all that it contains, discloses a drill bit assembly comprising a body portion intermediate a shank portion and a working portion. The working portion has at least one cutting element. The body portion has at least a portion of a reactive jackleg apparatus which has a chamber at least partially disposed within the body portion and a shaft movable disposed within the chamber, the shaft having at least a proximal end and a distal end. The chamber also has an opening proximate the working portion of the assembly.

Also, U.S. Pat. No. 5,038,873 to Jürgens, which is herein incorporated by reference for all that it contains, discloses a drill tool including a retractable pilot drilling unit driven by a fluid operated motor, the motor comprising a stator mounted on the interior of a tubular outer housing and a rotor mounted on the exterior of a tubular inner housing axially supported in said outer housing and rotationally free with respect thereto. The pilot drilling unit is rotationally fixed within the inner housing, but axially moveable therewithin so that pressure of drilling fluid used to drive the motor will also act on reaction surfaces of the pilot drilling unit to urge it axially forward. The top of the pilot drilling unit includes a fishing head for retracting the pilot drilling unit from the drilling tool, and reinserting it therein.

BRIEF SUMMARY OF THE INVENTION

In one aspect of the present invention, a drill bit for downhole drilling comprises a bore, cutting face, and an indenting element. The indenting element is disposed within the bore and comprises a shank connected to a distal end that is configured to engage a downhole formation. A support assembly is disposed within the bore and comprises a ring with a larger diameter than the shank. The support assembly further comprises a plurality of resilient arms which connect the shank to the ring.

The indenting element may be disposed coaxially with the drill bit and configured to protrude from the drill bit's cutting face.

The support assembly may be configured to push the indenting element towards the downhole formation such that an annular surface of the ring contributes to loading the indenting element. A plurality of fluid channels may be disposed intermediate the plurality of resilient arms.

The resilient arms may be configured to act as a spring that vibrates the indenting element or dampens an axial and/or side loads imposed on the indenting element. Instrumentation may be connected to the ring opposite of the indenting element and disposed between the ring and a thrusting surface within the bore. The instrumentation may be connected to a telemetry system or an electronic circuitry system.

The instrumentation may include an actuator and/or a sensor. The actuator may be configured to push off of the thrusting surface and the sensor may use the thrusting surface as a measurement reference. The actuator may comprise a piezoelectric or magnetostrictive material, and may be configured to vibrate the indenting element at a harmonic frequency that promotes destruction of downhole formation. The plurality of resilient arms may be configured to amplify a vibration generated by the actuator. The sensor may comprise a strain gauge or pressure gauge.

In some embodiments, the instrumentation may comprise a plurality of sensors and/or actuators disposed between the ring and the thrusting surface. These actuators and/or sensors may be configured to act together or independently.

In some embodiments, instrumentation may be disposed within each of the plurality of resilient arms. The instrumentation may be configured to move the resilient arms or to record data about the strain in the resilient arms.

In some embodiments, the support assembly may be configured to translate axially with respect to the drill bit. At least one valve may be disposed within the drill bit that controls the axial position of the indenting element by directing drilling fluid to push the indenting element either outwards or inwards.

In another aspect of the present invention, a drilling assembly comprises a drill bit comprising a bit body and a cutting surface. A formation engaging element protrudes from the cutting surface and is configured to engage a formation. At least one compliant member is disposed intermediate the bit body and formation engaging element and is configured to provide compliancy in a lateral direction for the formation engaging element.

The at least one compliant member may be configured to vibrate the formation engaging element or to dampen an axial and/or side load imposed on the formation engaging element. The at least one compliant member may comprise at least one hollow area in its wall thickness that is configured to provide compliance. The at least one hollow area may comprise a generally circular or polygonal cross-section. The at least one compliant member may be press fit into the bit body. A plurality of compliant members may be disposed intermediate the bit body and formation engaging element. The plurality of compliant members may be disposed around and/or behind the formation engaging element.

In some embodiments, the at least one compliant member may comprise a cylindrical shape configured to surround the formation engaging element. In some embodiments, the at least one compliant member may comprise a semi-cylindrical shape.

Instrumentation may be disposed within the at least one compliant member and may be connected to a telemetry system or an electronic circuitry system. The instrumentation may comprise at least one actuator and at least one sensor. The at least one actuator may be configured to pulse the formation engaging element. The at least one sensor may be configured to measure a load on the formation engaging element. The sensor may comprise a strain gauge or a pressure gauge. The instrumentation may comprise a plurality of sensors and/or actuators configured to act together or independently of each other. The instrumentation may also comprise a piezoelectric or magnetostrictive material.

The formation engaging element may comprise a downhole drilling cutting element. The formation engaging element may be press fit into the at least one compliant member.

DETAILED DESCRIPTION OF THE INVENTION AND THE PREFERRED EMBODIMENT

Figure 1:
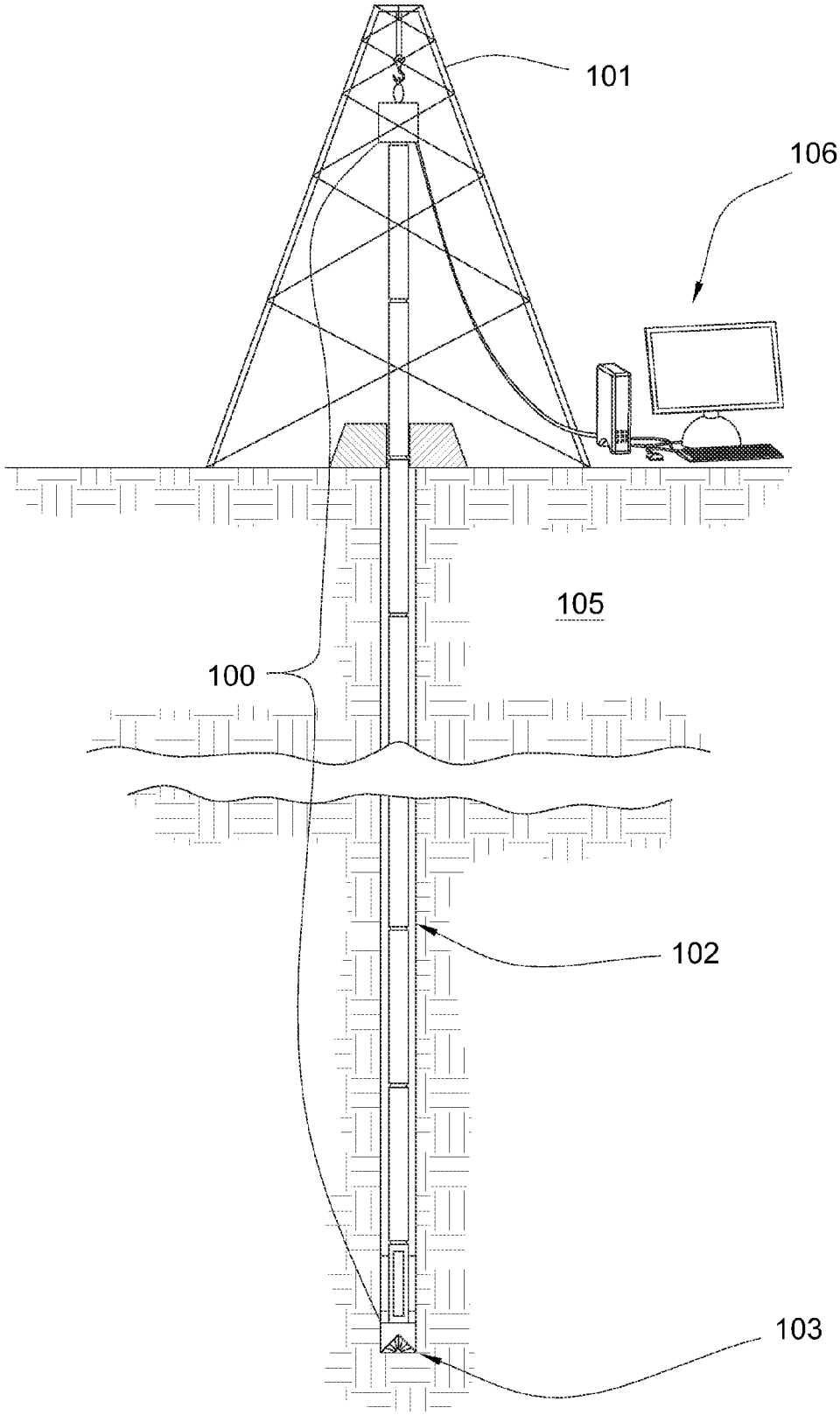
FIG. 1 is a perspective view of an embodiment of a drilling operation.

Referring now to the figures, FIG. 1 discloses a perspective view of an embodiment of a drilling operation comprising a downhole tool string 100 suspended by a derrick 101 in a wellbore 102. A drill bit 103 may be located at the bottom of the wellbore 102. As the drill bit 103 rotates downhole, the downhole tool string 100 advances farther into the earth. The downhole tool string 100 may penetrate soft or hard subterranean formations 105. The downhole tool string 100 may comprise electronic equipment able to send signals through a data communication system to a computer or data logging system 106 located at the surface.

Figure 2:
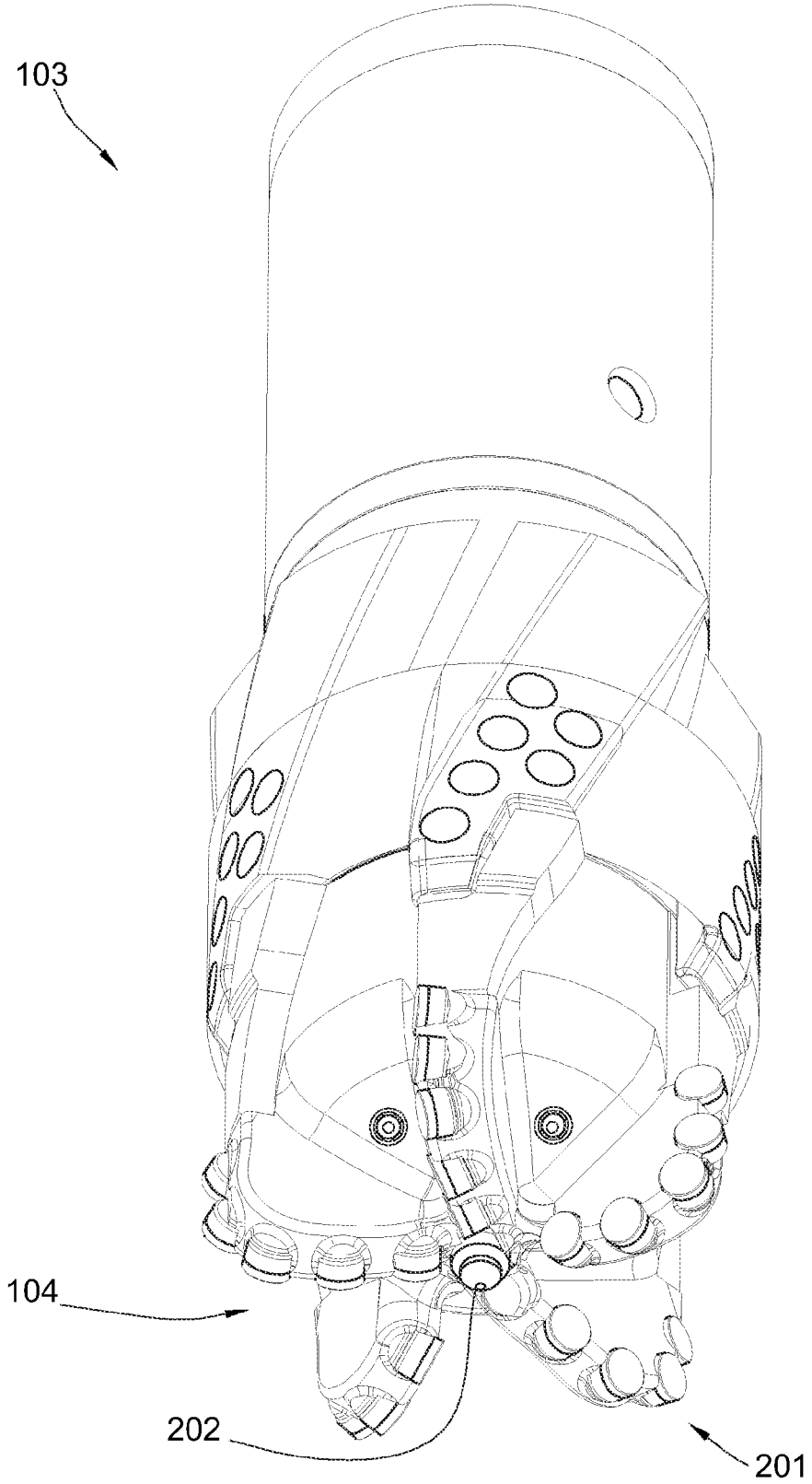
FIG. 2 is a perspective view of an embodiment of a drill bit.

FIG. 2 discloses a perspective view of an embodiment of the drill bit 103. The drill bit 103 comprises a cutting face 201 with a plurality of blades converging at the center of the cutting face 201 and diverging towards a gauge portion of the drill bit 103. The blades may be equipped with a plurality of cutting elements that degrade the formation. Fluid from drill bit nozzles may remove formation fragments from the bottom of the wellbore and carry them up the wellbore's annulus.

An indenting element 202 may be disposed coaxially with a rotational axis of the drill bit 103 and configured to protrude from the cutting face 201. By disposing the indenting element 202 coaxial with the drill bit 103, the indenting element 202 may stabilize the downhole tool string and help prevent bit whirl. The indenting element 202 may also increase the drill bit's rate of penetration by focusing the tool string's weight into the formation. During normal drilling operation, the indenting element 202 may be the first to come into contact with the formation and may weaken the formation before the cutters on the drill bit blades engage the formation.

Figure 3:
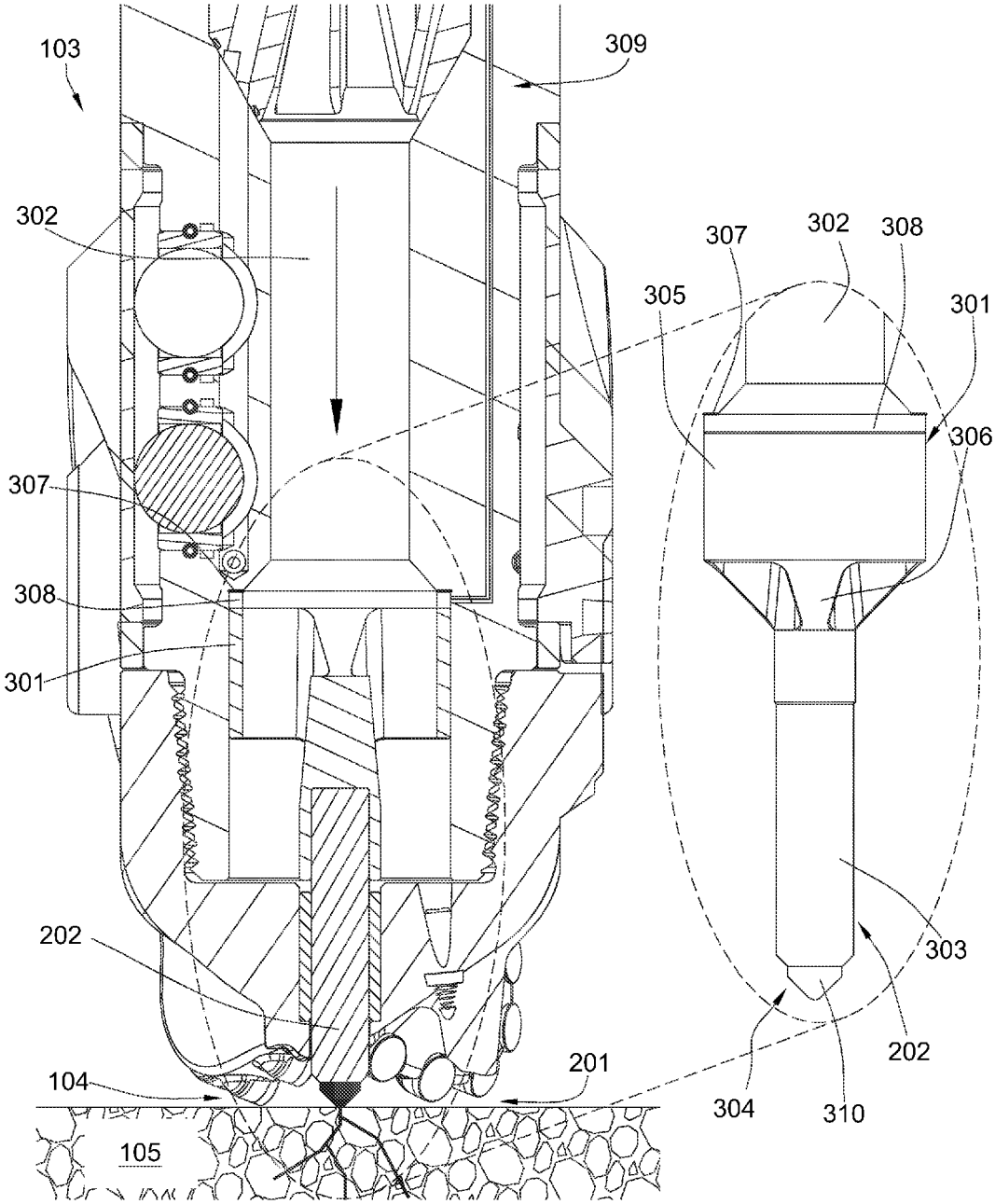
FIG. 3 is a cross-sectional view of another embodiment of a drill bit.

FIG. 3 discloses a drill bit 103 with a bore 302 and the cutting face 201. The indenting element 202 may be disposed within the bore 302 and may comprise a shank 303 connected to a distal end 304. The distal end 304 may be configured to protrude from the cutting face 201 and engage the downhole formation 105. The support assembly 301 may be disposed within the bore 302 and may comprise a ring 305 and a plurality of resilient arms 306. The ring 305 may comprise a larger diameter than the shank 303. The plurality of resilient arms 306 may connect the shank 303 to the ring 305. Fluid channels or by passes may be formed between the resilient arms.

The ring is positioned to abut against a thrusting surface 307 formed in the drill bit 103. It is believed that a ring with a larger diameter than the indenting element is advantageous because the ring's enlarged surface area may pick up more thrust than the indenting element's diameter would otherwise pick up. Therefore, more weight from the drill string may be loaded onto the indenting element.

The distal end 304 of the indenting element 202 may comprise a tip 310 comprising a superhard material. The superhard material may reduce wear on the tip 310 so that the tip 310 has a longer life. The superhard material may comprise polycrystalline diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, silicon carbide, metal catalyzed diamond, or combinations thereof.

This embodiment also discloses instrumentation 308 connected to the ring 305. The instrumentation 308 may be disposed opposite of the indenting element 202 and be intermediate the support assembly 301 and the thrusting surface 307. The instrumentation 308 may be connected to a telemetry system or an electronic circuitry system 309 that sends and receives information from the surface or other downhole locations. The instrumentation 308 may be in communication with the indenting element 202 through the resilient arms 306. The instrumentation may perform a variety of functions such as increasing the rate of penetration by vibrating the indenting element. The instrumentation may also be configured to measure the stresses and/or strains in the indenting element and/or support assembly. These measurements may provide information that may contribute to determining the drilling mechanics and/or formation properties.

Figure 4:
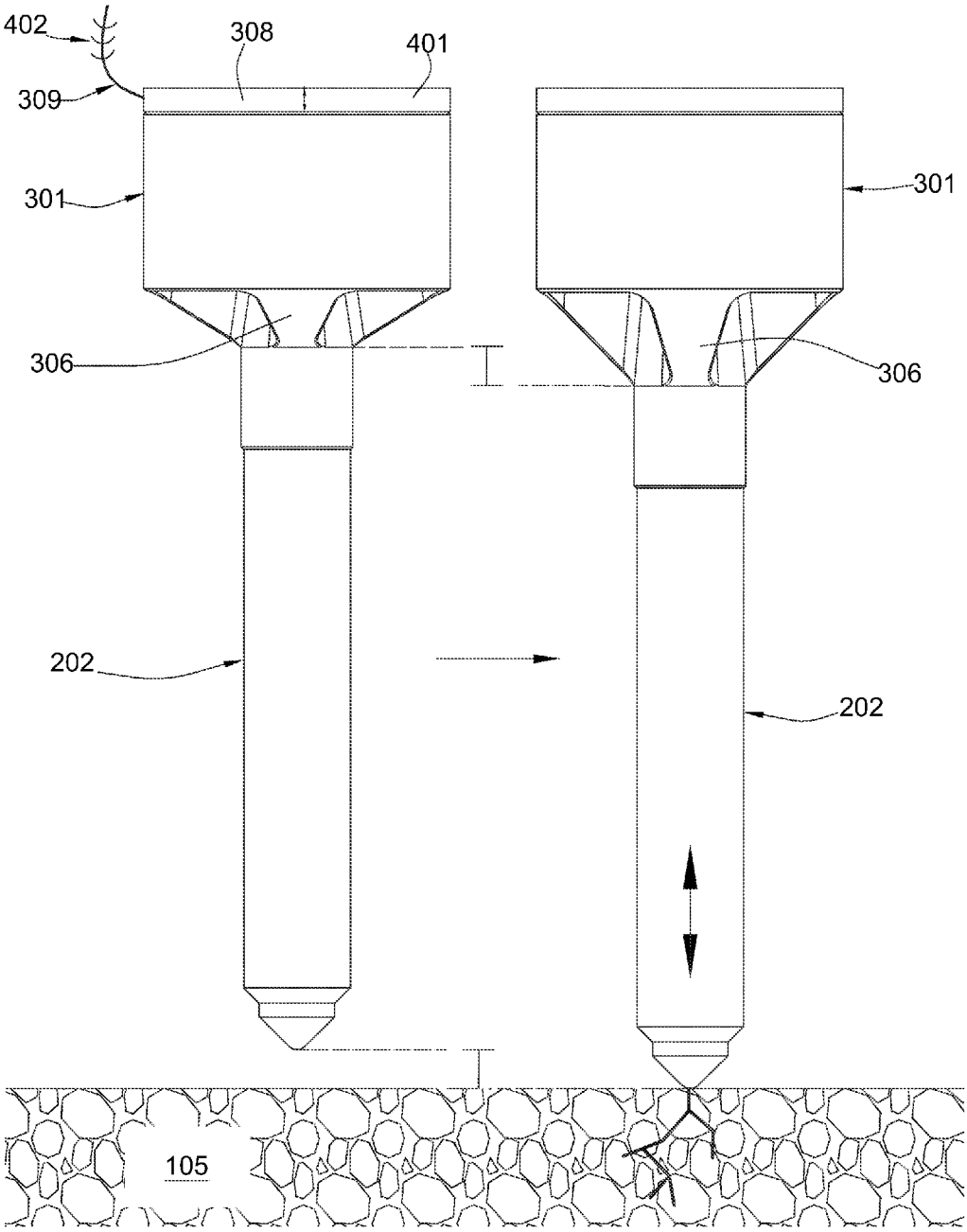
FIG. 4 is an orthogonal view of an embodiment of an indenting element connected to a support assembly.

FIG. 4 discloses an embodiment of the indenting element 202 connected to the support assembly 301 through the plurality of resilient arms 306. The instrumentation 308 may comprise a piezoelectric or magnetostrictive material. In the present embodiment, the instrumentation 308 comprises a piezoelectric material 401 wherein an electrical current 402 may be supplied through the electronic circuitry system 309. When electric current is passed through the piezoelectric material 401, the piezoelectric material 401 expands. The piezoelectric material may be vibrated by pulsing the electrical current through the material. As the piezoelectric material 401 vibrates, it may push off both the support assembly's ring and drill bit's thrusting surface. The resilient arms 306 may be configured to amplify this vibration. As the indenting element 202 pulses, it may contact and weaken the downhole formation 105, preferably at a harmonic frequency that is destructive to the formation 105. Preferably, the instrumentation 308 is configured to sense formation changes and thereby modify the vibrations wave form to tailor the vibrations as the preferred harmonic frequencies change.

Figure 5:
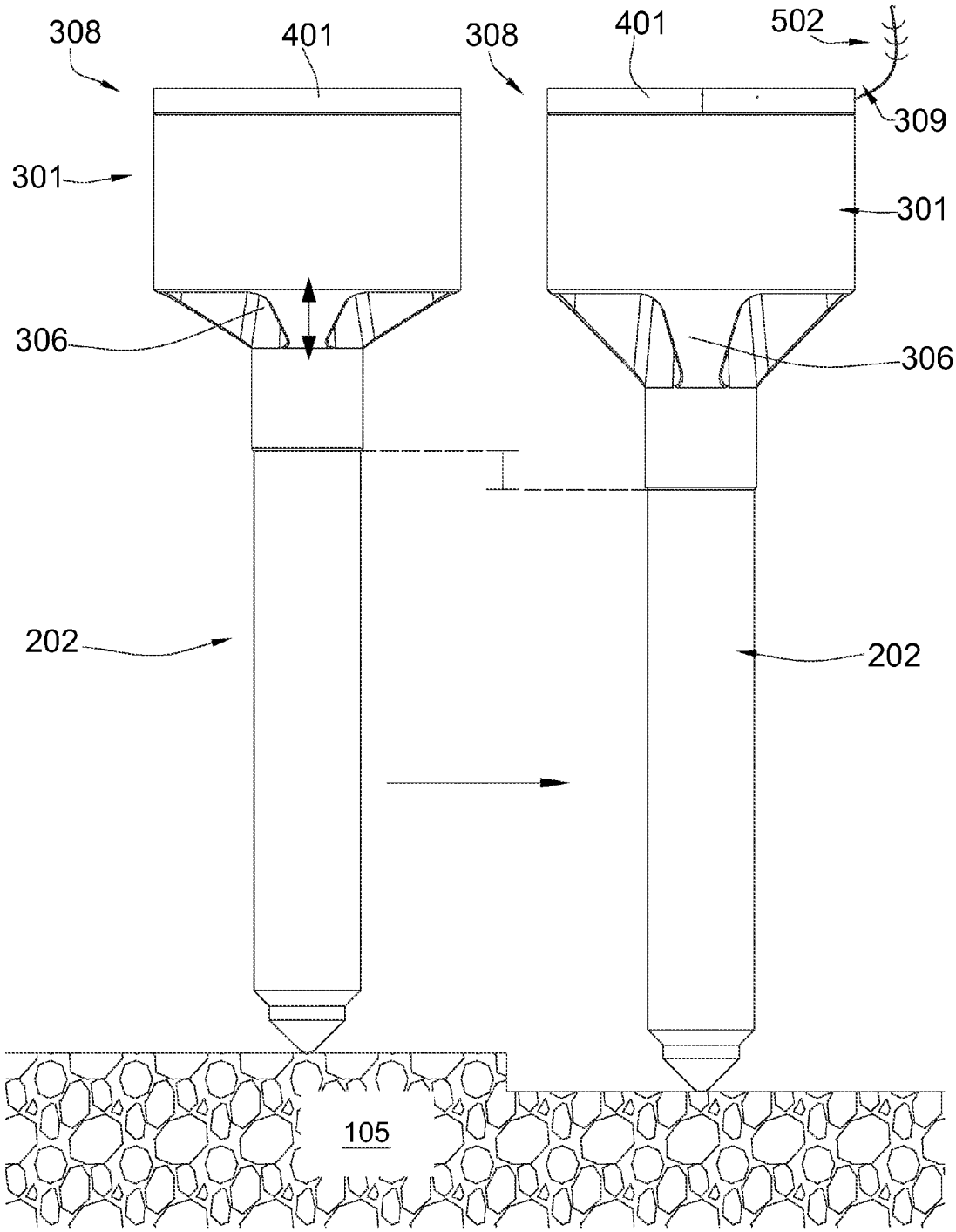
FIG. 5 is an orthogonal view of another embodiment of an indenting element connected to a support assembly.

FIG. 5 discloses another embodiment of the indenting element 202 connected to the support assembly 301 through a plurality of resilient arms 306. The instrumentation 308 may comprise a sensor 501. The sensor 501 may be configured to use the thrusting surface as a measurement reference. The sensor 501 may comprise a strain gauge or pressure sensor.

During normal drilling operations, the downhole formation 105 may push on the indenting element 202. The indenting element 202 may axially retract, forcing the resilient arms 306 to compress. The sensor 501 may capture data by sensing the forces acting on the indenting element 202 and how the resilient arms 306 compress. The data captured by the sensor 501 may result from the axial forces acting on the indenting element 202. The sensor 501 may be in communication with the piezoelectric material 401 such that the sensor 501 sequentially compresses the piezoelectric material 401. When compressed, the piezoelectric material 401 may produce an electrical current 502. The electrical current 502 may be sent through the electronic circuitry system 309 to the surface or may be stored within the downhole drill string.

Figure 6:
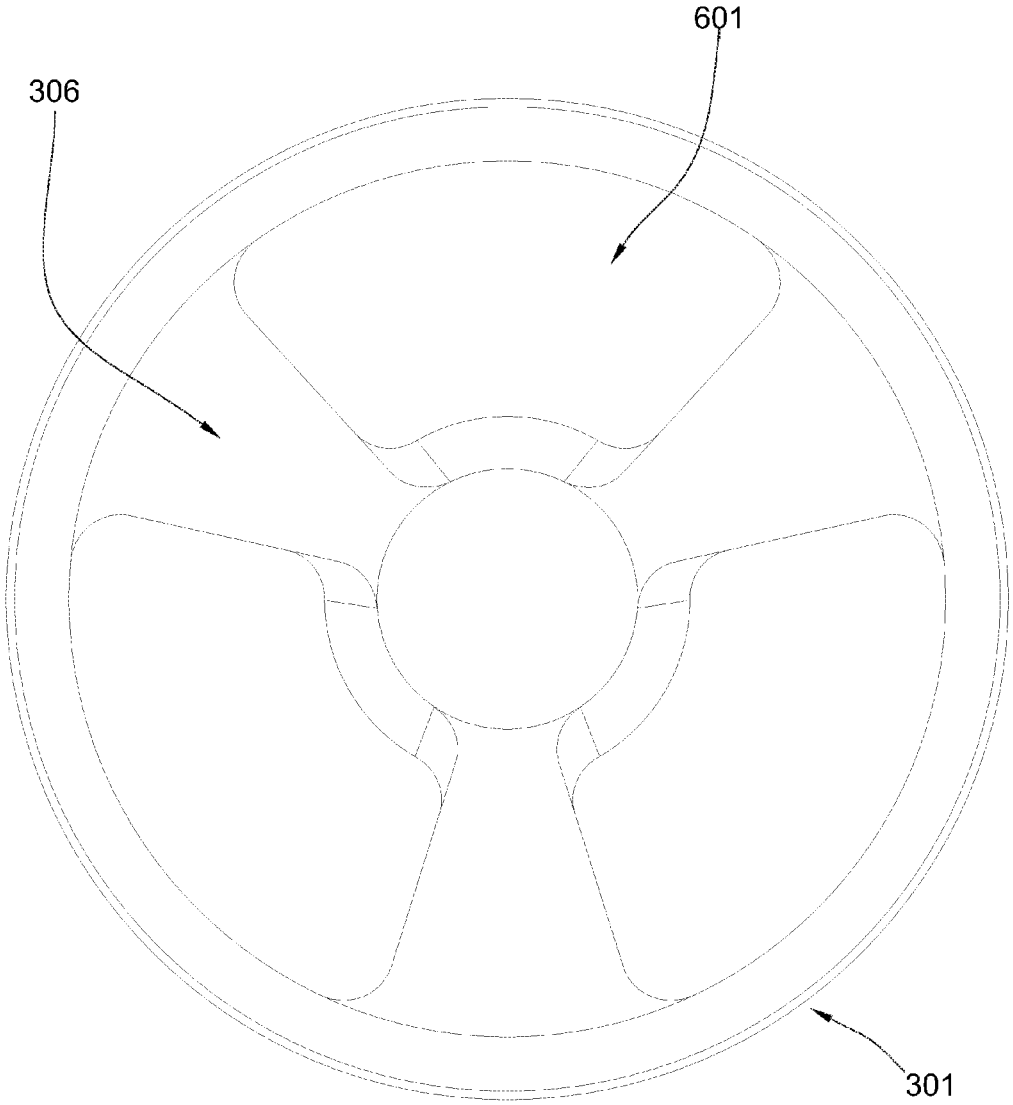
FIG. 6 is an orthogonal view of an embodiment of a support assembly.

FIG. 6 discloses an orthogonal view of an embodiment of the support assembly 301 comprising the plurality of resilient arms 306. A plurality of fluid channels 601 may be disposed within the support assembly 301 and intermediate the plurality of resilient arms 306. During normal drilling operations, drilling fluid may travel to the nozzles disposed within the cutting face via the bore of the drill bit. The support assembly 301 may be disposed within the bore and the fluid channels 601 allow fluid to flow past the support assembly 301. Due to the often abrasive drilling fluid, the resilient arms 306 may comprise a superhard material to reduce wear and increase the life of the support assembly 301.

Figure 7:
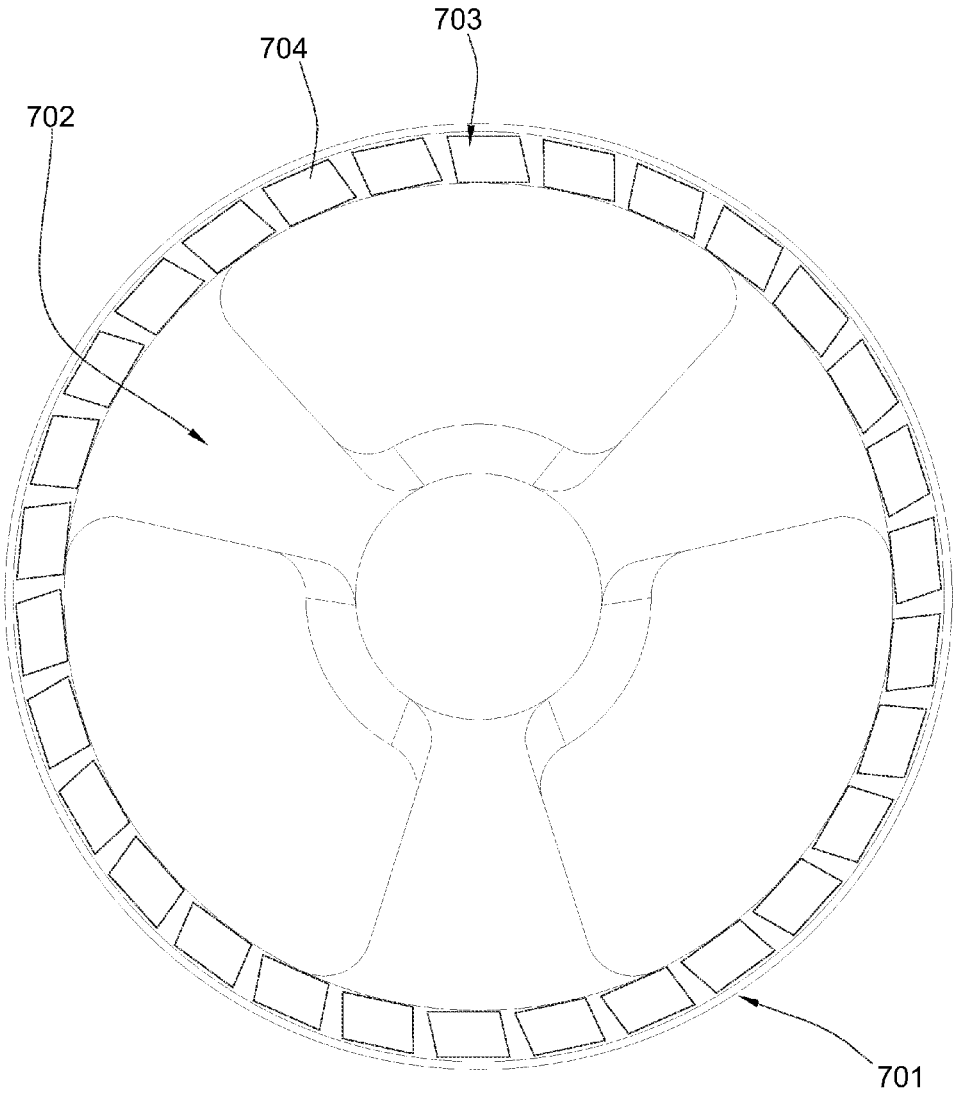
FIG. 7 is an orthogonal view of another embodiment of a support assembly.

FIG. 7 discloses an orthogonal view of another embodiment of a support assembly 701 comprising a plurality of resilient arms 702. Instrumentation 703 may be connected to the support assembly 701 opposite of the resilient arms 702 and disposed between the thrusting surface and the ring of the support assembly 701. The instrumentation 703 may comprise a plurality of sensors and/or actuators 704. An electric circuitry system may be in communication with each sensor and/or actuator 704 such that each sensor/actuator is configured to act together or independently of each other The plurality of sensor and/or actuators 704 may allow for more precise control of the indenting element, and for higher resolution measurements.

Figure 8:
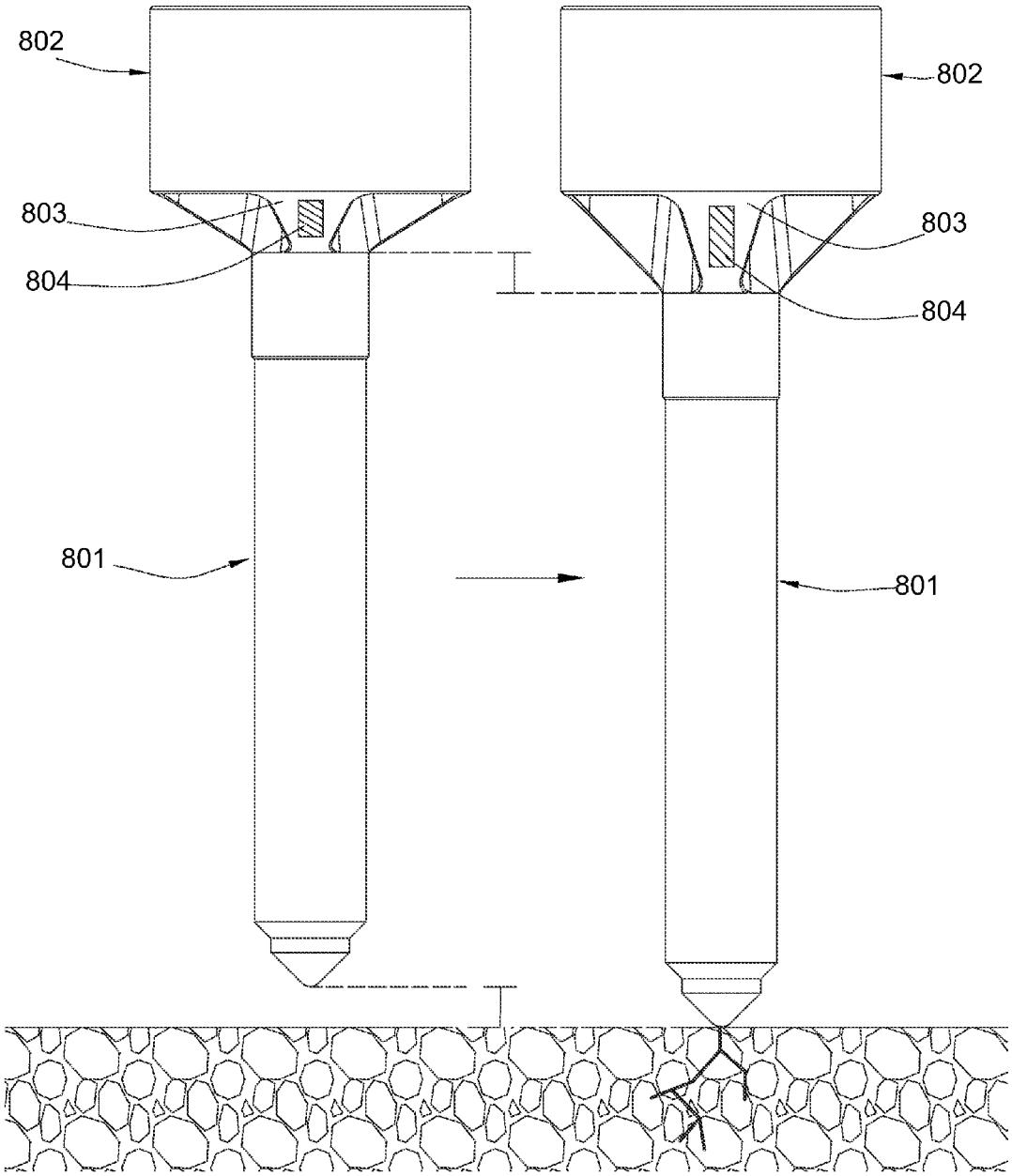
FIG. 8 is an orthogonal view of another embodiment of an indenting element connected to a support assembly.

FIG. 8 discloses an orthogonal view of another embodiment of an indenting element 801 connected to a support assembly 802 by a plurality of resilient arms 803. As shown in this embodiment, instrumentation 804 may be disposed within each of the resilient arms 803. The instrumentation 804 may be configured to move the resilient arms 803 so to pulse the indenting element 801, or to capture data from the strain in the resilient arms 803. It is believed that the instrumentation 804 disposed within each of the resilient arms 803 may allow for more precise control of the indenting element 801, and higher resolution of measurements.

Figure 9:
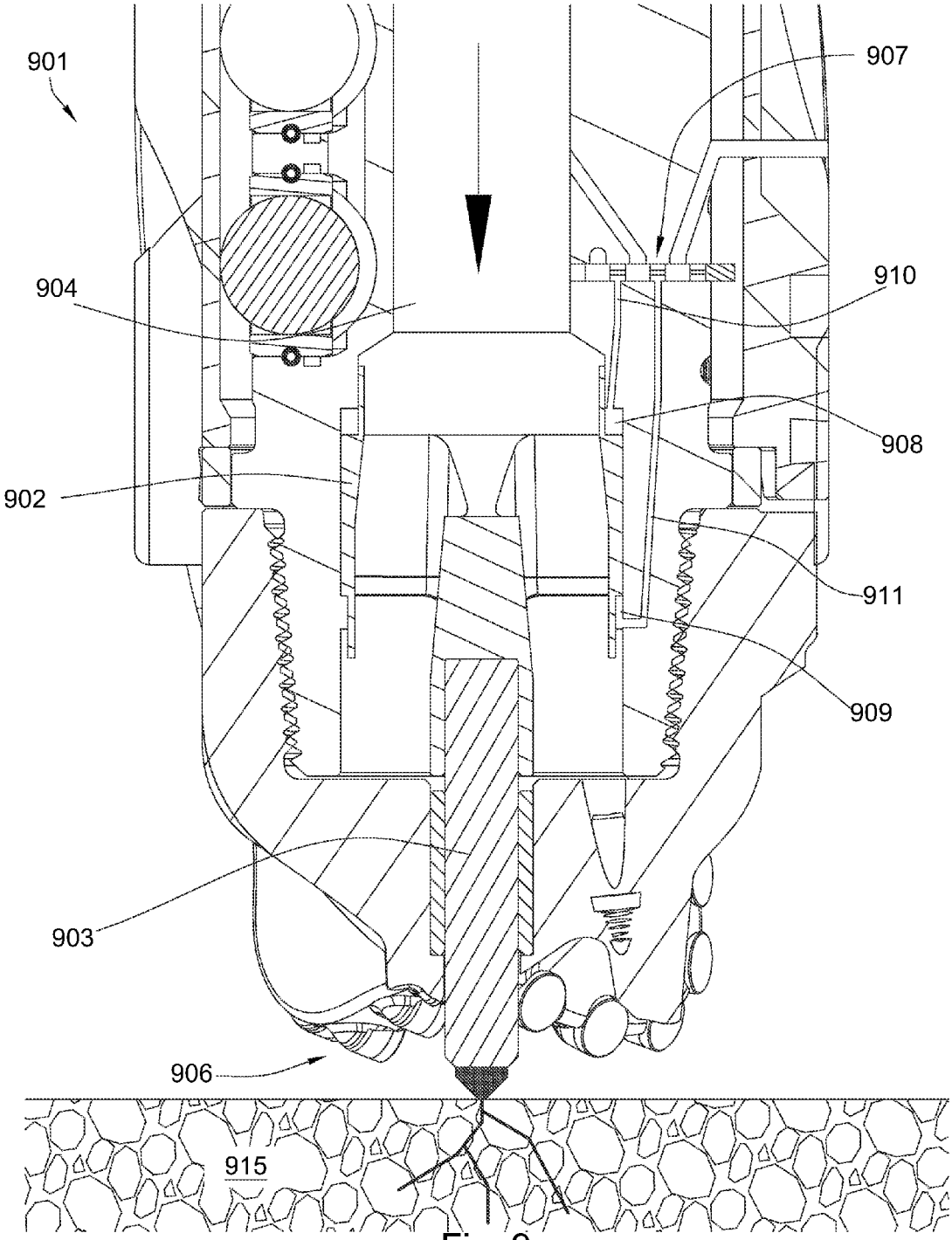
FIG. 9 is a cross-sectional view of another embodiment of a drill bit.

FIG. 9 discloses a cross-sectional view of an embodiment of a drill bit 901 comprising a support assembly 902 and an indenting element 903. The support assembly 902 may be disposed within a bore 904 of the drill bit 901 and may be configured to translate axially with respect to the drill bit 901.

The indenting element 903 may thus protrude and retract from a cutting face 906. Drilling fluid traveling within the bore 904 may be redirected to a valve 907 disposed within the drill bit 901. The valve 907 may be configured to control the drilling fluid into a first compartment 908 or a second compartment 909. The valve 907 may control the drilling fluid to flow through a first fluid pathway 910 and into the first compartment 908. As fluid fills the first compartment 908, the support assembly 902 is pushed and translates axially towards the downhole formation 915. Any fluid within the second compartment 909 may then exhaust through the second fluid pathway 911 and into the wellbore's annulus. The valve 907 may also direct the drilling fluid into the second compartment 909 forcing the support assembly 902 to translate axially away from the formation 915 and exhaust fluid within the first compartment 908 into the wellbore's annulus.

Figure 10:
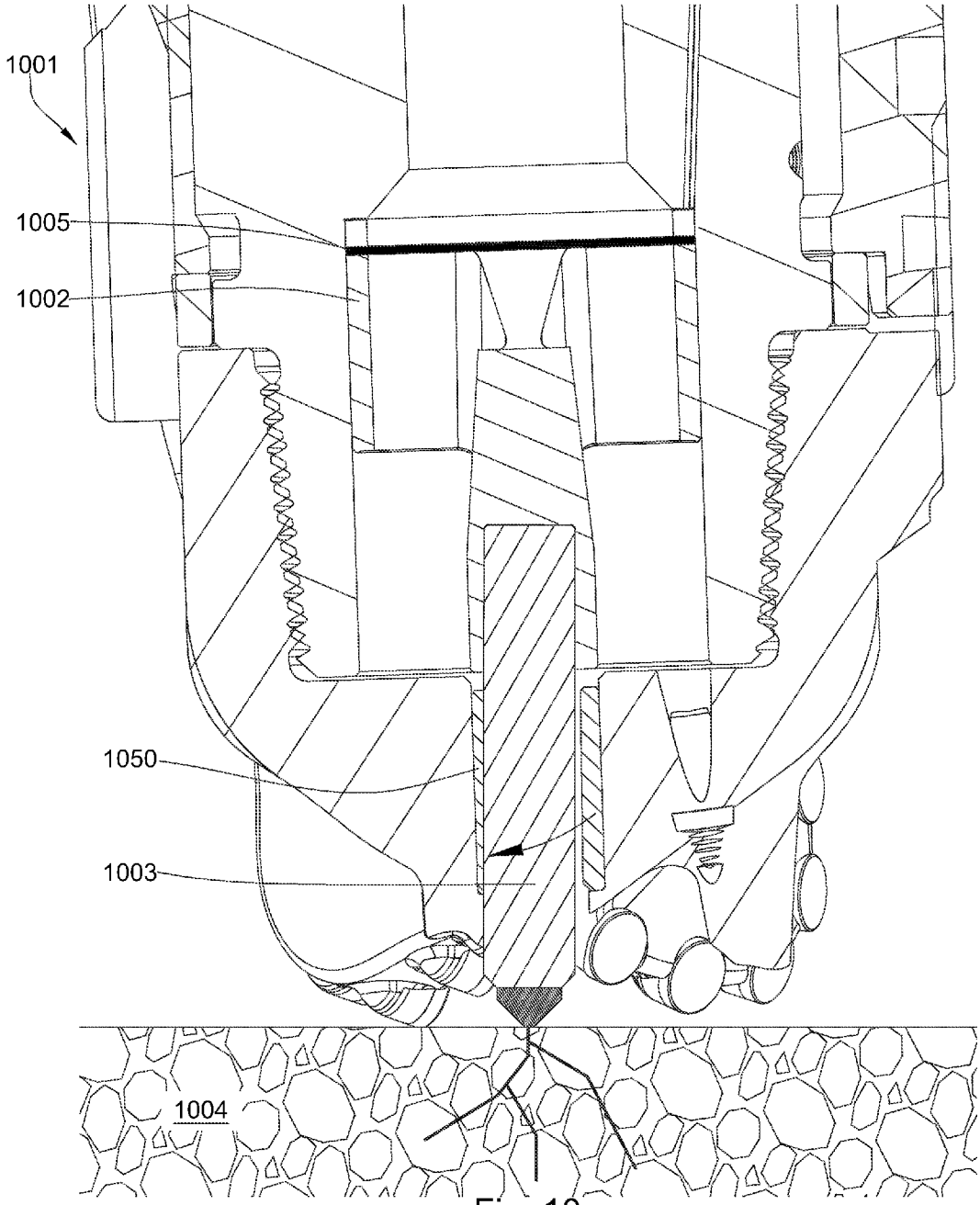
FIG. 10 is a cross-sectional view of another embodiment of a drill bit.

Now referring to FIG. 10, during normal drilling operations, the downhole formation 1004 may exert axial and lateral forces on the indenting element 1003. As lateral forces act on the indenting element 1003, a support sleeve 1050 may yield and compensate for the lateral forces. A sensor disposed within a hollow section of the support sleeve may capture data of the compensation. Both axial and lateral force data measured by the sensor may provide a realistic understanding of the forces on the drill bit.

Further, a compliant support sleeve may dampen the lateral forces on the indenting element, thereby increasing the indenting member's capacity to withstand side loads.

Figure 11:
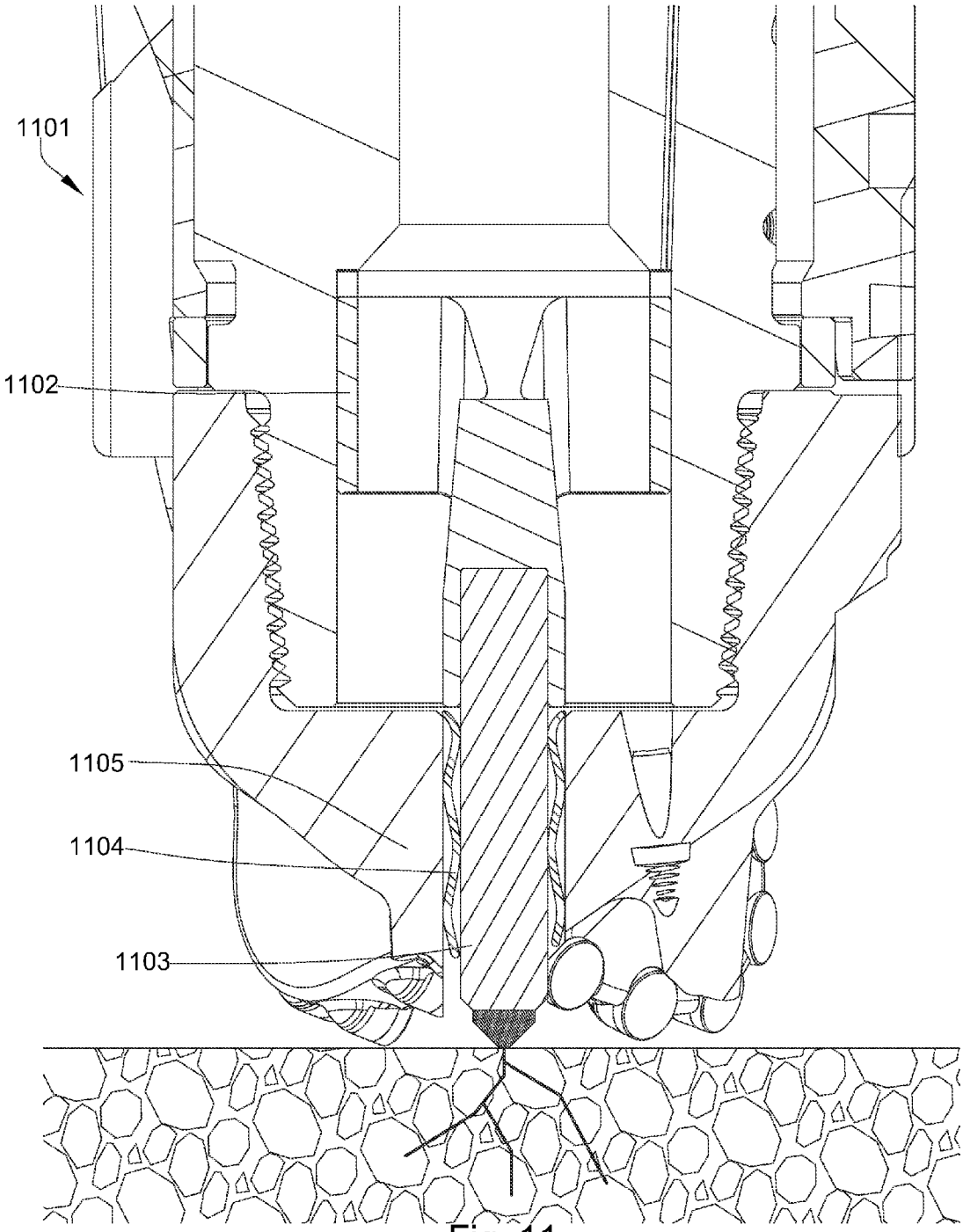
FIG. 11 is a cross-sectional view of another embodiment of a drill bit.

FIG. 11 discloses a cross-sectional view of an embodiment of a drill bit 1101 comprising a support assembly 1102 and an indenting element 1103. At least one spring 1104 may be disposed intermediate the indenting element 1103 and a drill bit body 1105. The spring 1104 may add support to the indenting element 1103 but allow the indenting element 1103 to move laterally. In the present embodiment, the spring 1104 comprises a wave spring.

Figure 12:
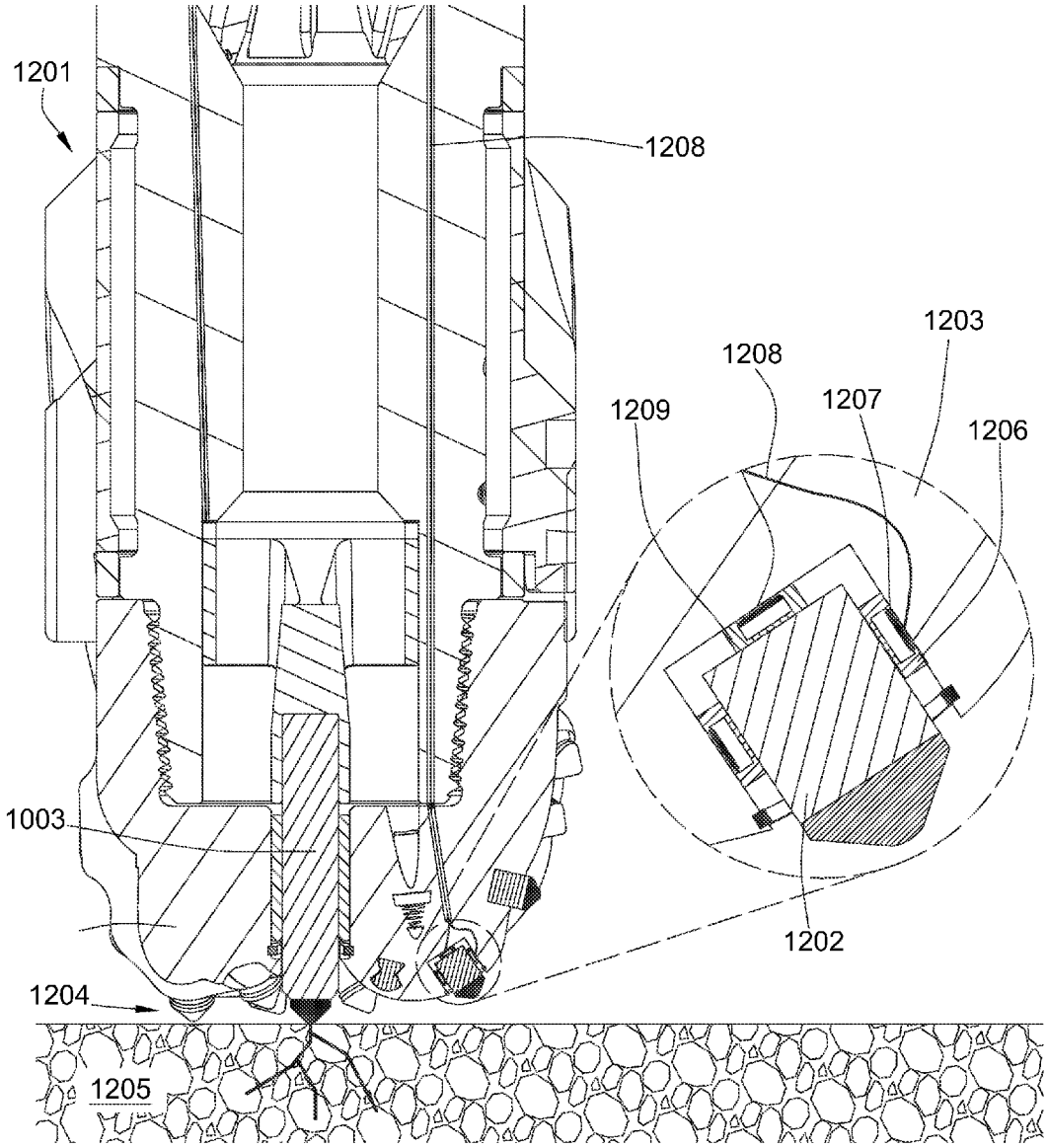
FIG. 12 is a cross-sectional view of another embodiment of a drill bit.
Figure 13A:
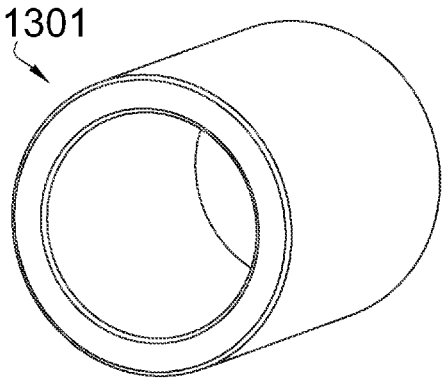
FIG. 13*a* is a perspective view of an embodiment of a compliant member.
Figure 13B:
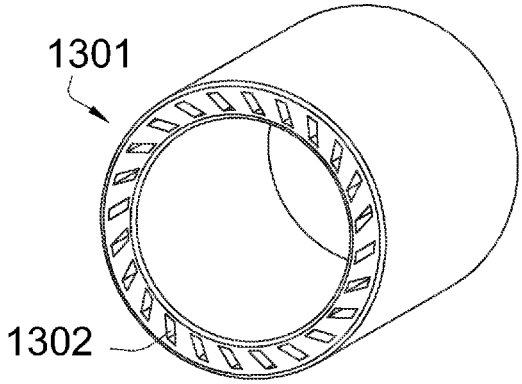
FIG. 13*b* is a perspective view of another embodiment of a compliant member.
Figure 13C:
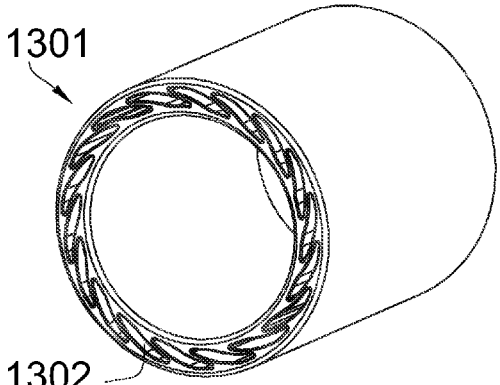
FIG. 13*c* is a perspective view of another embodiment of a compliant member.
Figure 13D:
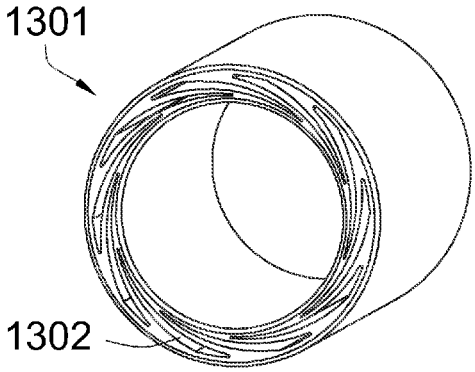
FIG. 13*d* is a perspective view of another embodiment of a compliant member.
Figure 13E:
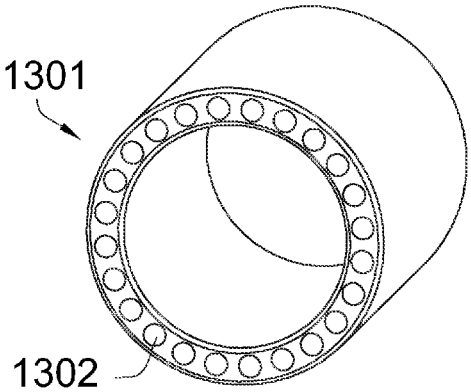
FIG. 13*e* is a perspective view of another embodiment of a compliant member.
Figure 13F:
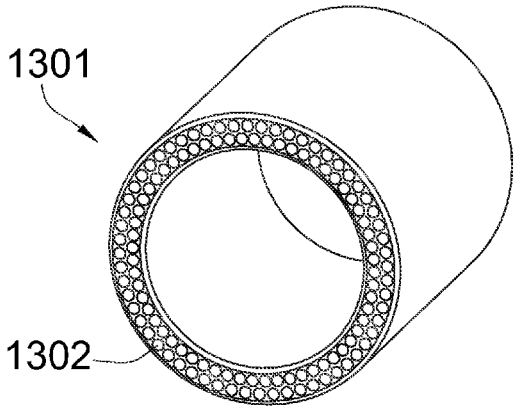
FIG. 13*f* is a perspective view of another embodiment of a compliant member.

FIG. 12 discloses a cross-sectional view of an embodiment of a drill bit 1201 with a magnified portion disclosing a formation engaging element 1202. The drill bit 1201 may comprise a bit body 1203 and a cutting surface 1204. The formation engaging element 1202 may protrude from the cutting surface 1204 and be configured to engage and degrade a formation 1205. In the present embodiment, the formation engaging element 1202 comprises a downhole drilling cutting element. In some embodiments, the indenting member is the engaging element 1003.

At least one compliant member 1206 may be disposed intermediate the bit body 1203 and the formation engaging element 1202. The compliant member 1206 may be configured to provide compliancy in both axial and lateral directions with respect to the formation engaging element 1202. During normal drilling operations, the formation 1205 may exert forces on the formation engaging element 1202, and the compliant member 1206 dampens these forces on the formation engaging element 1202. In the present embodiment, a plurality of compliant members is disposed around and behind the formation engaging element 1202.

Instrumentation 1207 may be disposed within at least one compliant member 1206. The instrumentation 1207 may comprise at least one actuator and/or sensor. The actuator may be configured to pulse the formation engaging element 1202 to induce a vibration into the formation. In some embodiments, the vibrations may comprise a waveform characteristic that is destructive to the formation. In some embodiments, the actuator may control an angle or precise position of the engaging element. In embodiments where the instrumentation is a sensor, the sensor may be configured to measure loads in at least one direction on the engaging element 1202. The sensor may comprise a strain gauge or a pressure gauge that may capture data about the downhole conditions. In some embodiments, the instrumentation may induce a vibration into the formation, measure the formation's reflected vibration, and induce the formation with an adjusted vibration. In this manner, induced vibrations may be customized for the formation's characteristics.

The instrumentation 1207 may be in communication with a telemetry system or an electronic circuitry system. Information may be passed between surface equipment or data processors within the drill string and the instrumentation 1207. In the present embodiment, the instrumentation 1207 is connected to an electronic circuitry system 1208. The telemetry or electronic circuitry system may pass data from the instrumentation to other components or send control instructions to the instrumentation. The instrumentation 1207 may also comprise a piezoelectric or magnetostrictive material.

FIGS. 13*a* through 13*f* disclose embodiments of compliant members 1301. Each disclosed embodiment comprises a cylindrical shape configured to surround a formation engaging element. The compliant members may each comprise at least one hollow area 1302, in the wall thickness that is configured to provide compliancy for the formation engaging element. The hollow areas 1302 may provide space for the compliant members 1301 to deform as forces from the downhole formation are exerted on the formation engaging element. Hollow areas may comprise a generally polygonal or a generally circular cross-section.

Figure 14:
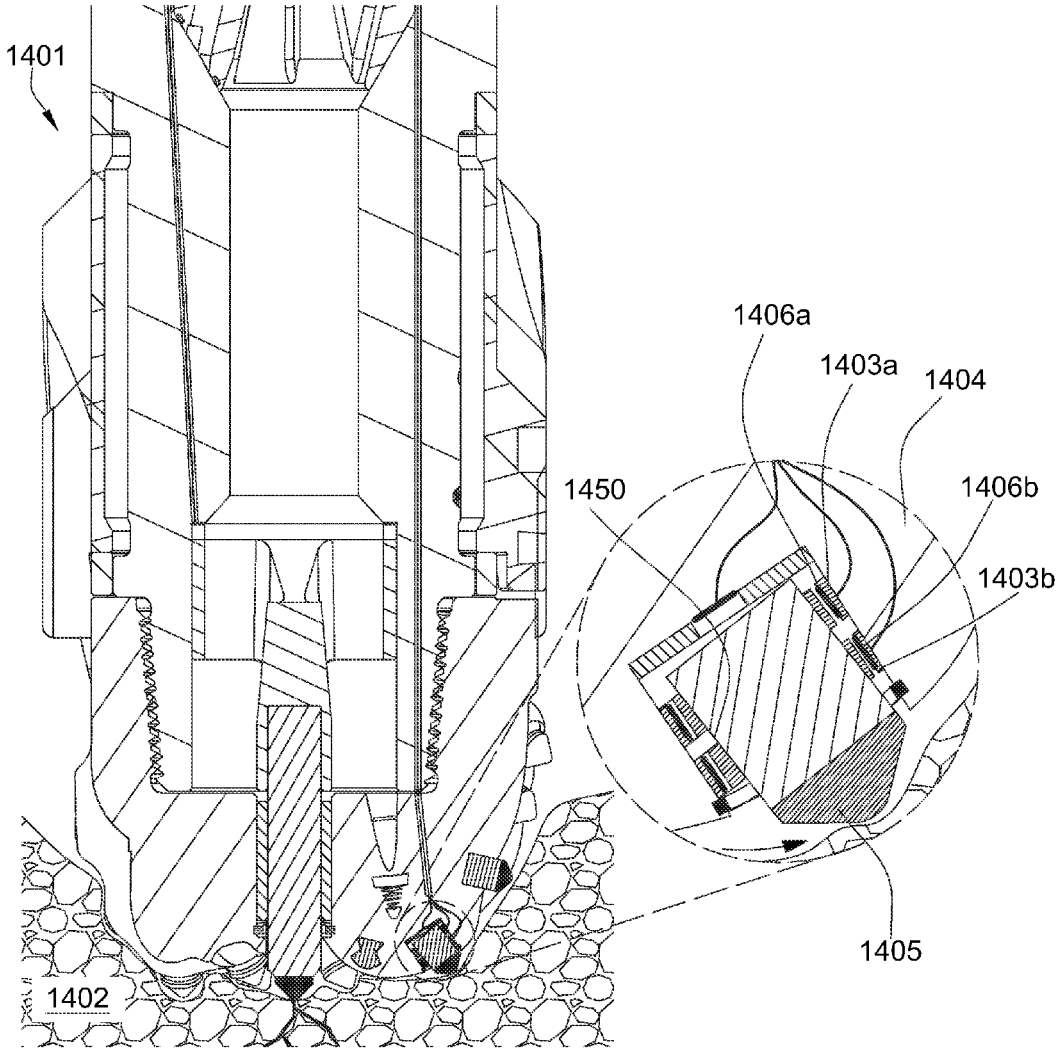
FIG. 14 is a cross-sectional view of another embodiment of a drill bit.

FIG. 14 discloses an embodiment of a drill bit 1401 as it engages a downhole formation 1402. A plurality of compliant members 1403*a* and 1403*b* may be disposed axially along a length 1450 of the engaging element. Each of the compliant members 1403*a* and 1403*b* may comprise instrumentation 1406*a* and 1406*b* that records separate data. For example, the engaging member may experience a greater side load nears its tip 1405 than at its base. Thus, separate instrumentation for measuring these different side loads may be beneficial.

Figure 15:
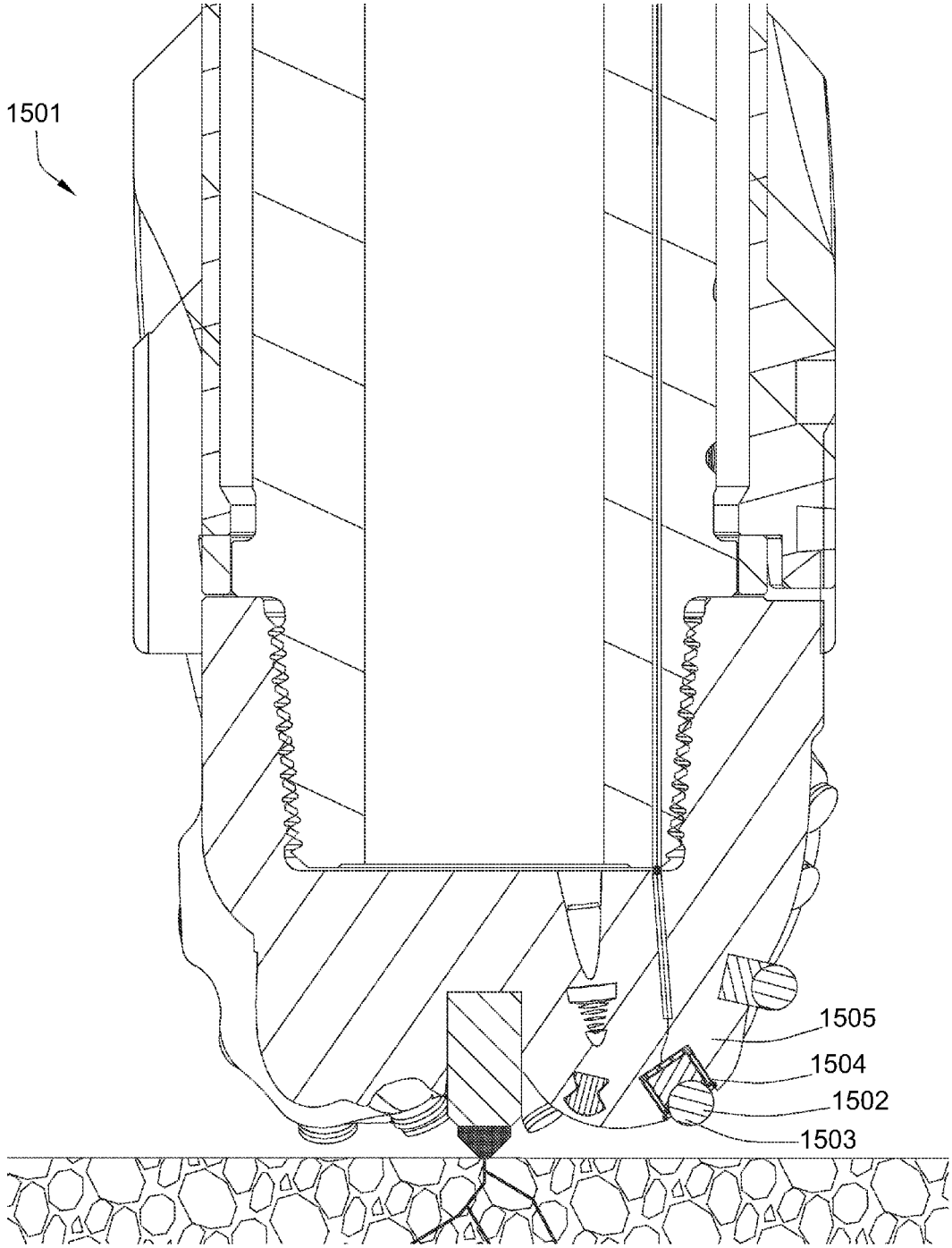
FIG. 15 is a cross-sectional view of another embodiment of a drill bit.

FIG. 15 discloses an embodiment of a drill bit 1501 with a formation engaging element 1502 comprising a downhole drilling shear cutter 1503. In the present embodiment, the shear cutter 1503 may be press fit into the at least one compliant member 1504, which may be press fit into the bit body 1505.

Figure 16A:
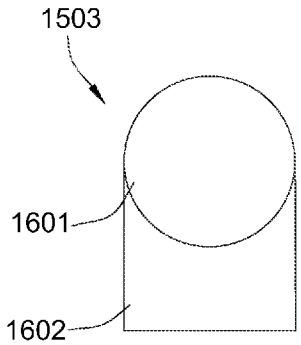
FIG. 16*a* is an orthogonal view of an embodiment of a cutting element.
Figure 16B:
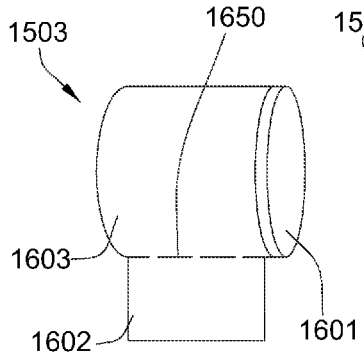
FIG. 16*b* is a perspective view of another embodiment of a cutting element.
Figure 16C:
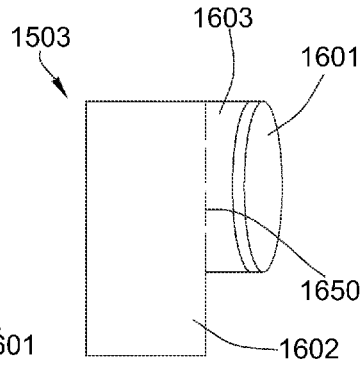
FIG. 16*c* is a perspective view of another embodiment of a cutting element.

FIGS. 16*a* through 16*c* disclose embodiments of a shear cutter 1503 that may be compatible with the present invention. FIG. 16*a* discloses an orthogonal view of the shear cutter 1503 that comprises a cutting face 1601 and a cutter body 1602.

The cutting face 1601 may be disposed on a substrate 1603 and the substrate 1603 may be brazed onto the cutter body 1602 at a braze joint 1650.

Figure 17A:
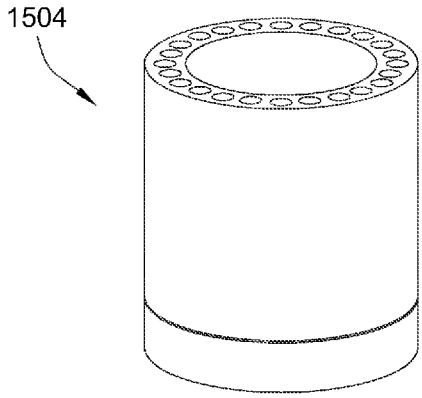
FIG. 17*a* is a perspective view of another embodiment of a compliant member.
Figure 17B:
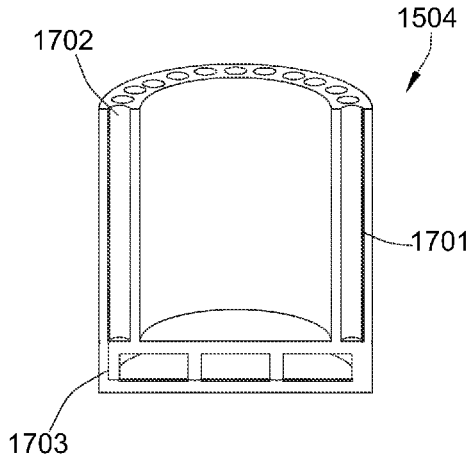
FIG. 17*b* is a cross-sectional view of another embodiment of a compliant member.

FIGS. 17*a* and 17*b* disclose embodiments of the compliant member 1504. The compliant member 1504 may comprise instrumentation 1701 comprising a plurality of sensors and/or actuators. The plurality of sensors and/or actuators may be configured to act together or independently of each other. Electrical wiring 1703 may connect the instrumentation in each hollow area 1702.

Figure 18A:
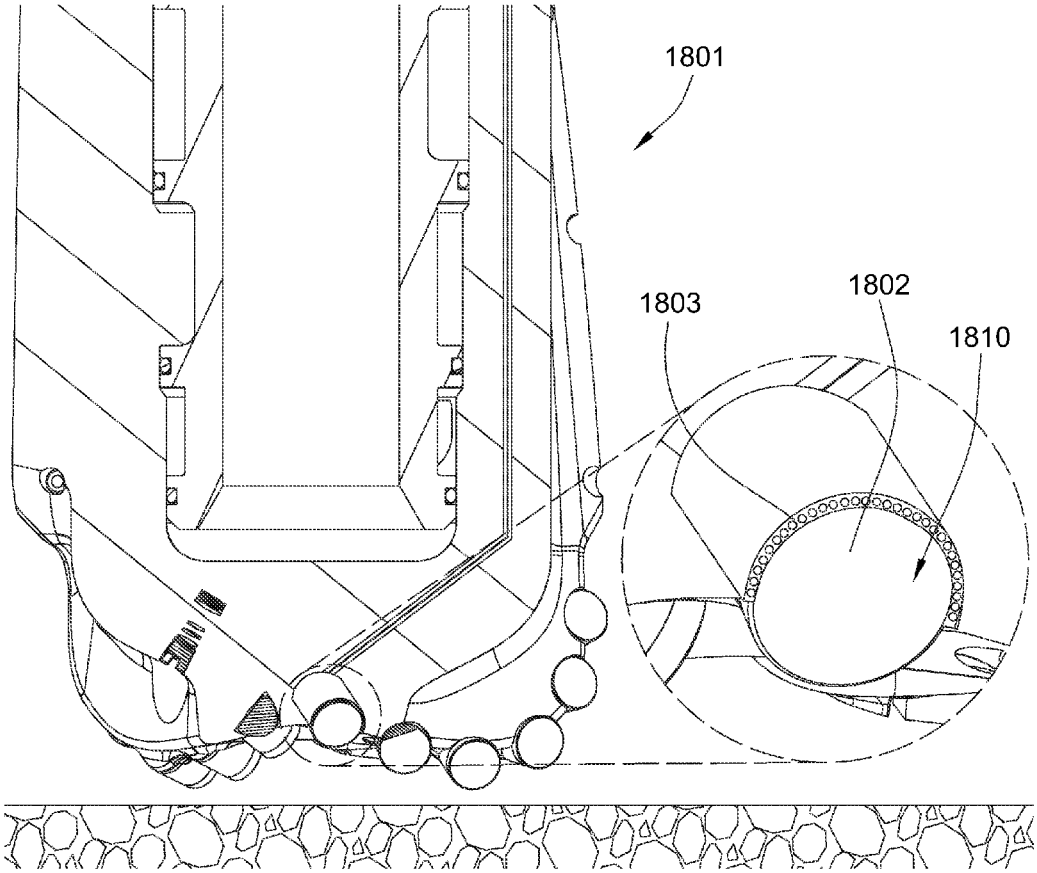
FIG. 18*a* is a cross-sectional view of another embodiment of a drill bit.
Figure 18B:
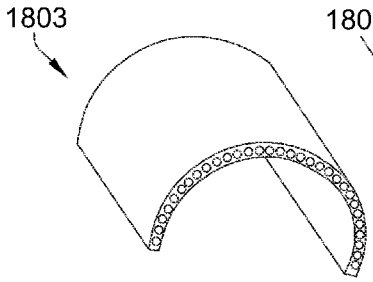
FIG. 18*b* is a perspective view of another embodiment of a compliant member.
Figure 18C:
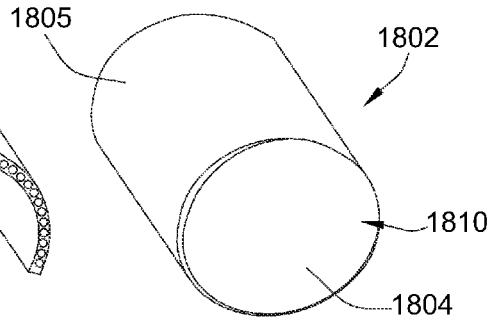
FIG. 18*c* is a perspective view of another embodiment of a cutting element.

FIGS. 18*a* through 18*c* disclose an embodiment of a formation engaging element 1802 and a compliant member 1803. The formation engaging element 1802 may comprise a shear cutter 1810 comprising a cutting face 1804 and a substrate 1805. The shear cutter 1810 may be positioned on the drill bit 1801 such that at least part of the substrate's diameter may be exposed to the formation. The compliant member 1803 may comprise a semi-cylindrical shape to surround just a part of the substrate's diameter. In this embodiment, the compliant member will be away from the engagement point between the engaging member and the formation. However, this shape may still provide sufficient contact with the drill bit's blade to dampen and/or measure side load forces.

Whereas the present invention has been described in particular relation to the drawings attached hereto, it should be understood that other and further modifications apart from those shown or suggested herein, may be made within the scope and spirit of the present invention.

What is claimed is:

1. A drilling assembly, comprising:

a drill bit comprising a bit body and a cutting surface;

a formation engaging element protruding from the cutting surface and configured to engage a formation;

at least one compliant member disposed intermediate the bit body and formation engaging element;

the at least one compliant member is configured to provide compliancy in a lateral direction for the formation engaging element; and instrumentation disposed within the at least one complaint member.

2. The assembly of claim 1, wherein the at least one complaint member is configured to dampen an axial and/or side load imposed on the formation engaging element.

3. The assembly of claim 1, wherein the at least one complaint member is configured to vibrate the formation engaging element.

4. The assembly of claim 1, wherein the instrumentation comprises at least one actuator configured to pulse the formation engaging element.

5. The assembly of claim 1, wherein the instrumentation comprises a piezoelectric or magnetostrictive material.

6. The assembly of claim 1, wherein the instrumentation comprises at least one sensor configured to measure a load on the formation engaging element.

7. The assembly of claim 6, wherein the sensor comprises a strain gauge or pressure gauge.

8. The assembly of claim 1, wherein the instrumentation is connected to a telemetry system or an electronic circuitry system.

9. The assembly of claim 1, wherein the instrumentation comprises a plurality of sensors and/or actuators disposed within the at least one compliant member and are configured to act together or independently of each other.

10. The assembly of claim 1, wherein a plurality of compliant members are disposed around and/or behind the formation engaging element.

11. The assembly of claim 1, wherein the formation engaging element comprises a downhole drilling cutting element.

12. The assembly of claim 1, wherein the at least one compliant member comprises a cylindrical shape configured to surround the formation engaging element.

13. The assembly of claim 1, wherein the at least one compliant member comprises a semi-cylindrical shape.

14. The assembly of claim 1, wherein the at least one compliant member comprises at least one hollow area in its wall thickness that is configured to provide compliance.

15. The assembly of claim 14, wherein the at least one hollow area comprises a generally circular cross-section.

16. The assembly of claim 14, wherein the at least one hollow area comprises a generally polygonal cross-section.

17. The assembly of claim 1, further comprising a plurality of compliant members disposed intermediate the bit body and formation engaging element.

18. The assembly of claim 1, wherein the at least one compliant member is press fit into the bit body.

19. The assembly of claim 1, wherein the formation engaging element is press fit into the at least one compliant member.

* * * * *